United States Patent [19]

Thomas

[11] Patent Number: 4,623,185

[45] Date of Patent: Nov. 18, 1986

[54] BOTTLE CARRIER

[76] Inventor: Ronald S. Thomas, 115 Lakeland Way, Roswell, Ga. 30076

[21] Appl. No.: 740,822

[22] Filed: Jun. 3, 1985

[51] Int. Cl.[4] ..... B65D 71/00

[52] U.S. Cl. ..... 294/87.28; 206/158; 206/199

[58] Field of Search ..... 294/27.1, 87.2–87.28, 294/92, 143, 145, 159, 162, 163; 206/145, 147, 158, 161, 162, 199, 201, 427; 211/74, 75; 215/100 A; 248/312, 312.1

[56] References Cited

U.S. PATENT DOCUMENTS

| | | | |
|---|---|---|---|
| 1,474,322 | 11/1923 | Ducorron | 294/27.1 |
| 2,067,124 | 1/1937 | Hoffman | 294/87.28 |
| 2,264,903 | 12/1941 | Kruea | 248/312 X |
| 2,435,833 | 2/1948 | Hazelet | 294/87 |
| 2,440,902 | 5/1948 | Lutey | 294/87.28 |
| 2,447,934 | 8/1948 | Doppelheuer | 294/92 X |
| 2,513,715 | 7/1950 | Deerwester | 294/87.28 |
| 2,604,354 | 7/1952 | Gray | 294/87.2 |
| 2,616,751 | 11/1952 | Goldenberg | 294/87.28 |
| 2,637,475 | 5/1953 | Gialanella | 294/87.2 X |
| 2,647,786 | 8/1953 | Locke | 294/87.28 |
| 2,841,435 | 7/1958 | Rochon | 294/87.28 |
| 2,865,669 | 12/1958 | Linthicum | 294/87.2 |
| 3,167,347 | 1/1965 | Hewlings | 294/87.2 |
| 3,552,612 | 1/1971 | Greis | 294/87.28 |
| 3,804,309 | 4/1974 | Kwak | 294/87.22 X |

*Primary Examiner*—Johnny D. Cherry
*Attorney, Agent, or Firm*—Thomas & Kennedy

[57] ABSTRACT

A bottle carrier has a web formed with a hand grip opening and an array of fork tines that extend transversely beneath the hand grip opening. Walls extend uprightly from an open end of tine pairs to prevent bottles from sliding off the tines.

4 Claims, 4 Drawing Figures

BOTTLE CARRIER

TECHNICAL FIELD

This invention relates generally to bottle carriers, and particularly to carriers of the type designed for hand carrying one or more bottles in an unpackaged configuration.

BACKGROUND OF THE INVENTION

Carriers have heretofore been devised for carrying one or more bottles in an unpackaged configuration. Exemplary of such carriers are those shown in U.S. Pat. Nos. 2,440,902, 2,435,833, 2,604,354, 2,637,475 and 3,804,309. These bottle carriers of the prior art have ordinarilly been designed to carry relatively small bottles such as milk bottles and cola bottles. The net weight of even a small group of such bottles has thus also been small. More recently, however, the sizes of bottles has increased substantially so that today it is common to find two and three liter bottles sold at retail. This increase in the size of bottles has been accompanied by an increase in their weight. As a result, bottle carriers of the prior art are often unsuitable for carrying the relatively large bottles of today. This is at least partially due to the fact that the prior art carriers were not designed to support one or more large bottles with their combined weight located beneath the carrier hand grip. With those carriers of the prior art that could carry one or more bottles, the net load usually could only be centered beneath the hand grip with the carrier and load tilted. This tilting can interfere with the body of the person that is carrying the load or with adjacent objects. This can create a hazard either to such objects or to the bottles themselves. The present invention is accordingly directed to a bottle carrier of a type by which one or more relatively large bottles may be carried with ease in an upright position with the net weight located beneath a hand grip.

SUMMARY OF THE INVENTION

In one form of the invention a bottle carrier is provided for hand carrying in an upright position a bottle or a set of bottles of the type having an annular projection or enlargement about the bottle neck and with the net weight of the bottles centered beneath the hand. The bottle carrier has an upright web formed with a central opening that provides a hand grip, and an array of tines that project laterally to each side of the upright web below the opening. Adjacent tines in the array are spaced apart a distance to support a bottle neck projection and are formed with stop means for inhibiting a supported bottle from sliding off the tines.

In another form of the invention a bottle carrier has an elongated handle and a fork extending beneath and transversely to the handle. The fork has a pair of tines that are closed at one end by a bridge located to one side of the elongated handle. Raised stop means are located adjacent an open end of the tines to the other side of the handle. So constructed, a bottle neck may be passed through the tines open end and over the raised stop means and into a position supported upon the fork beneath the handle.

In yet another preferred form of the invention a bottle carrier of unitary construction has a plate-like section formed with an elongated hand grip and an array of tines that extend transversely to the elongated hand grip. Pairs of adjacent tines within the array have coplanar ledges upon which a bottle neck enlargement may be supported. The carrier also has means for inhibiting a bottle supported on the ledges from sliding off.

DETAILED DESCRIPTION

Figure 1:
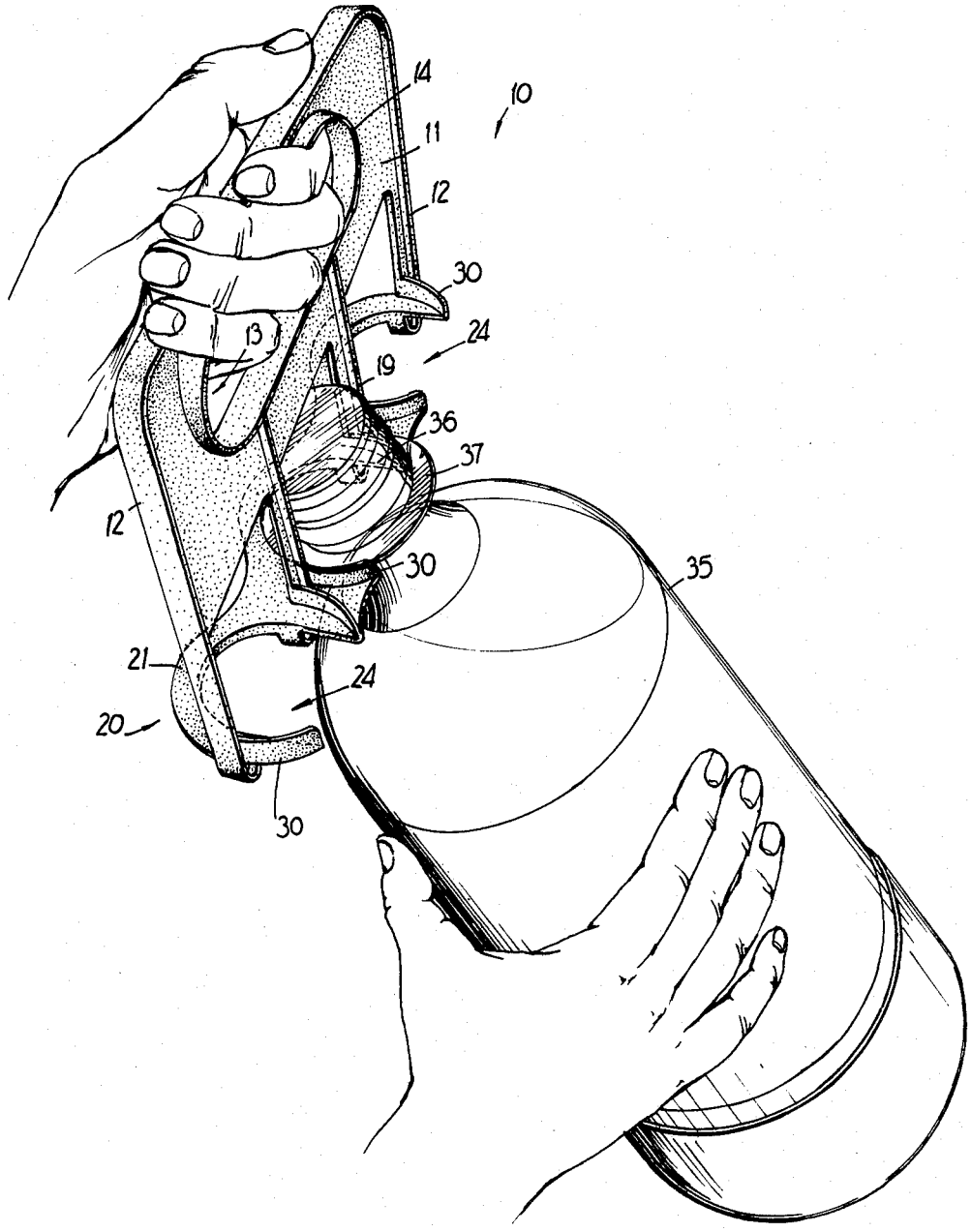
FIG. 1 is a perspective view of a bottle carrier embodying principles of the invention to which a bottle is shown in the process of being loaded upon or unloaded from the carrier.

With reference next to the drawing, there is shown a bottle carrier 10 which here is of unitary, plastic construction and which includes an upright flat, plate-like or web section 11 that is partially bounded by a peripheral ridge or lip 12. The web 11 is formed with a central upper opening 13 bordered by a race-track shaped ridge or lip 14. The opening 13, in conjunction with the ridges 12 and 14, forms a hand grip in which a hand is shown in place.

Directly beneath the central upper opening 13 the web defines a lower bottle head receiving opening 17. Two other bottle head receiving openings 18 are shown to be defined by the web so as to straddle the opening 17. A pair of strengthening ribs 19 extends downwardly from the race-track shaped ridge 14 between the openings 17 and 18. These ribs and ridges all project laterally to each side of the web 11.

At the bottom of the openings 17 and 18 is formed a horizontal platform indicated generally at 20 which has a planar, upper surface 21 that projects laterally to each side of the web 11. The platform is formed with three openings with one opening 23 being located directly beneath the bottle head receiving opening 17 and with two other openings 24 being located beneath bottle head receiving openings 18 thereby straddling the opening 23. One end of these openings is closed by a bridge portion 25 of the platform while the other end is opened to provide an entry and exit for a bottle neck. Each of the openings 23 and 24 is bounded by two straight, mutually parallel, side edges 27 that merge with a semicircular edge 28. A pair of arcuate wall sections 30 extend upwardly from the upper surface of the platform 20 adjacent the entry into the openings 23 and 24. With the platform constructed in this manner it provides an array of tines that provide three juxtaposed forks. Its upper surface effectively provides ledges about openings 23 and 24. Preferably, the entire carrier is of unitary, plastic construction and has bilateral symmetry.

Figure 3:
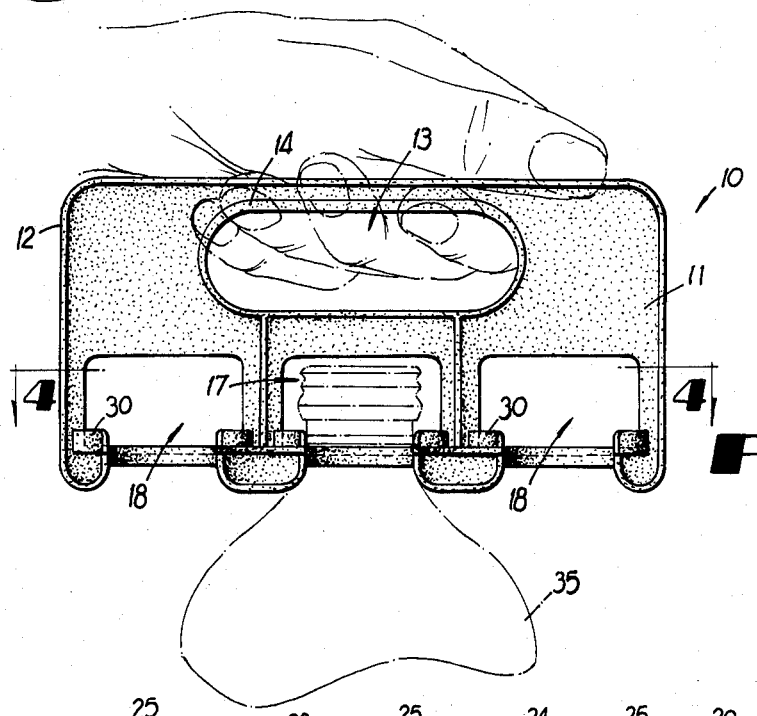
FIG. 3 is another side elevational view of the bottle carrier of FIG. 1 shown supporting a single bottle.
Figure 4:
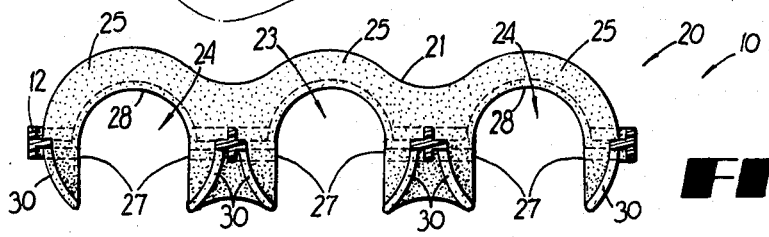
FIG. 4 is a plan view taken in cross section along plane 4—4 of the bottle carrier illustrated in FIG. 3.

In use, a single bottle 35 may be supported upon the bottle carrier as shown in FIG. 1. Here, the bottle is a two or three liter, plastic cola type bottle which has a thin neck portion that merges with a cap head shown at 36 and about which an annular flange 37 radially projects. To mount the bottle the bottle is tilted with respect to the carrier, as shown in FIG. 1, and its annular neck flange 37 passed over the top of the upright walls 30 and onto the ledges about the opening 23. Once the bottle is seated the annular flange 37 is positioned upon the platform within the bounds of the central pair of arcuate walls 30 with the bottle head occupying the space within opening 27, as shown in FIG. 3. Once it has been seated it should be noted that the weight of the bottle is centered directly beneath the central, hand grip opening 13 which enables the bottle to be carried in an upright position with the center of gravity of the load located directly beneath the user's hand. It should also be appreciated that the bottle is inhibited from sliding off the base by the bridge area 25 to the rear of opening 23 and by the upright walls 30 adjacent the open entry into opening 23. To dismount or unload the bottle the procedure is reversed with either the bottle or the carrier being tilted and the bottle head and flange passed over the top of the walls 30.

Figure 2:
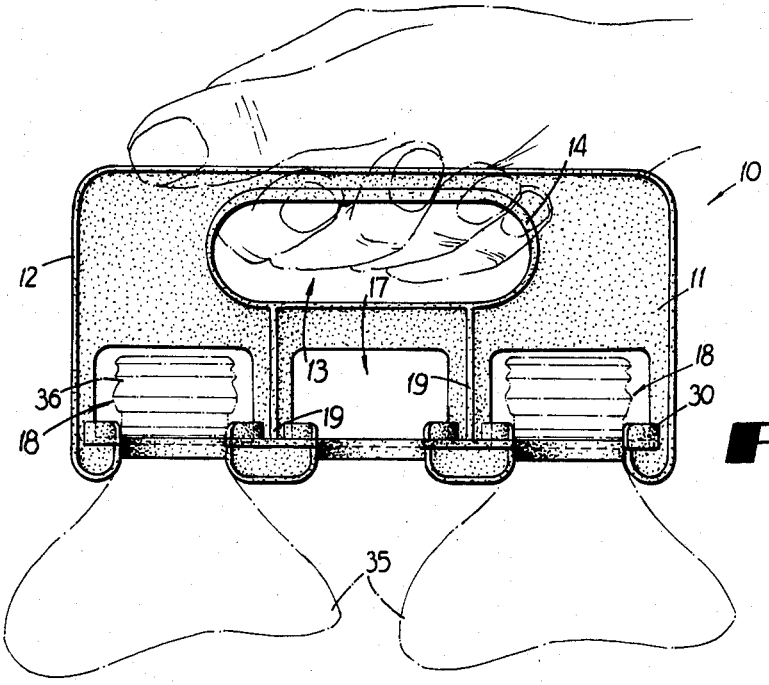
FIG. 2 is a side elevational view of the bottle carrier illustrated in FIG. 1 shown supporting two bottles.

The same bottle carrier may also be used to carry two bottles as shown in FIG. 2. The procedure for mounting and dismounting each bottle remain the same. Once supported upon the carrier platform it will be noted that the combined weight of the two bottles is again centered directly beneath the hand grip provided by the space 13. In this drawing it is seen that the bottles are of a sufficient size as to occupy some of the space beneath the central opening 17 and therefore is not suitable for carrying three of these sized bottles. However, where desired the dimensions of the bottle carrier may be made to accommodate three bottles.

It is thus seen that a bottle carrier is provided of simple and economic construction preferably for carrying one, two or three bottles in an upright configuration with the net weight of the bottles, regardless of number, centered beneath a hand grip. The carrier could, of course, accommodate a larger number by providing additional forks. However, the number of openings and forks is preferably limited to three in view of the substantial weight of the bottles that the carrier is specifically designed to carry. If desired, the stop means for preventing the bottles from sliding off the base ledge may be provided by inclining the ends of the tines themselves at their entry. In such a case, the bottles are loaded in the same manner by tilting the bottle and sliding the neck enlargement or flange over the top of the inclined tine ends. Though the bottle here is shown with an enlarged flange at the neck the carrier may be used to support any type of bottle that has an enlargement located at or above the neck.

It should be understood that the just described embodiment merely illustrates principles of the invention in a preferred form. Many modifications, additions and deletions in addition to that expressly suggested may, of course, be made thereto without departure from the spirit and scope of the invention as set forth in the following claims.

I claim:

1. A bottle carrier for hand carrying in an upright position a bottle or a set of bottles of the type having an annular projection about the bottle neck with the net weight of the bottles centered directly beneath the hand, and with the bottle carrier having an upright web formed with a central upper opening that provides a hand grip, an array of tines that project laterally to each side of said upright web below said central upper opening, and with a central lower opening beneath said central upper opening of a size to accommodate the capped head of a bottle supported on said tines, and with adjacent tines within said array being spaced apart a distance to support a bottle neck projection thereon within said central lower opening and being formed with stop means for inhibiting a supported bottle from sliding off said tines and out of said central lower opening.

2. The bottle carrier of claim 1 wherein a pair of tines straddle the bottom of said support lower opening.

3. The bottle carrier of claim 1 wherein said web is formed with additional support lower openings to each side of said support lower opening.

4. The bottle carrier of claim 3 wherein pairs of tines straddle the bottom of said support lower opening and straddle the bottoms of each of said additional support lower openings.

* * * * *